US006591975B2

(12) United States Patent
Kim

(10) Patent No.: US 6,591,975 B2
(45) Date of Patent: Jul. 15, 2003

(54) INLET ROLLING DEVICE OF POWER EXHAUST CONVEYOR FOR PACKING SHEET USED IN SHARING AND PACKING DEVICE OF MEDICINE

(75) Inventor: June Ho Kim, Daegu (KR)

(73) Assignee: JV Medi Co., Ltd., Daegu (KR)

( * ) Notice: Subject to any disclaimer, the term of this patent is extended or adjusted under 35 U.S.C. 154(b) by 0 days.

(21) Appl. No.: 09/964,731

(22) Filed: Sep. 28, 2001

(65) Prior Publication Data

US 2003/0019727 A1 Jan. 30, 2003

(30) Foreign Application Priority Data

Jul. 24, 2001 (KR) ..... 2001-22367 U

(51) Int. Cl.[7] ..... B65G 13/02; B65G 13/12
(52) U.S. Cl. ..... 198/782; 198/780; 198/836.2
(58) Field of Search ..... 198/836.1, 836.2, 198/837, 780, 782; 193/35 R, 37

(56) References Cited

U.S. PATENT DOCUMENTS 4,696,392 A * 9/1987 Chisholm, Jr. ..... 198/836.2
4,790,421 A * 12/1988 Gorges ..... 198/780 X
5,575,465 A * 11/1996 Auerbach et al. .... 198/836.2 X
5,599,015 A * 2/1997 Shimizu et al. ..... 198/782 X
5,626,219 A * 5/1997 Deefholts et al. .... 198/836.2 X

* cited by examiner

*Primary Examiner*—James R. Bidwell
(74) *Attorney, Agent, or Firm*—Jacobson Holman PLLC

(57) ABSTRACT

An inlet rolling device of power exhaust conveyor for packing sheet used in sharing and packing device of medicine according to the present invention, wherein the power exhaust conveyor is so constructed that a sponge roller is mounted on the inlet side, a shaft is mounted at the central portion of the sponge roller, and a support is connected to the end portion of the shaft and to a hinge shaft fixed to a mounting plate so as to be rotated, thereby enabling the packing sheet containing medicine to be discharged to the outside, comprises a hollow shaft attached to the central portion of the sponge roller and mounted to a shaft so as to be rotated, a primary pulley mounted on the end portion of the hollow shaft, a secondary pulley mounted on a hinge shaft so as to be rotated, a primary belt interconnecting the primary and secondary pulleys, and a secondary belt interconnecting the secondary pulley and a driving pulley mounted on the shaft of a motor for driving the exhaust conveyor.

1 Claim, 3 Drawing Sheets

INLET ROLLING DEVICE OF POWER EXHAUST CONVEYOR FOR PACKING SHEET USED IN SHARING AND PACKING DEVICE OF MEDICINE

BACKGROUND OF THE INVENTION

The present invention relates to an inlet rolling device mounted on the inlet side of power exhaust conveyor for packing sheet used in sharing and packing device of medicine which is designed to feed packing sheet containing medicine prescribed dose by dose, and more particularly, an inlet rolling device of power exhaust conveyor for packing sheet used in sharing and packing device of medicine, which allows packing sheet to come into a power exhaust conveyor easily and the power exhaust conveyor to discharge the packing sheet to the outside easily by rotating an inlet sponge roller by means of power.

In general, a medicine sharing and packing device denotes a machine designed to automatically dispense and pack tablets and powder prescribed dose by dose for a patient. Packing sheet is unrolled from a packing sheet roll and continuously fed. Medicine is dropped from a hopper into the folded packing sheet. The folded packing sheet containing medicine continuously comes into and is sealed by a pair of heating rollers so that medicine is packed dose by dose.

For a conventional sharing and packing device of medicine, packing sheet containing medicine prepared as prescribed is fed by a feed roller, cut by a cutter, and discharged to the outside along the discharge support plate. For a large-sized one, a power exhaust conveyor is provided to discharge the packing sheet containing medicine to the outside.

As showed in FIG. 3, a conventional exhaust conveyor is so constructed that a sponge roller 101 is mounted on the inlet side, a shaft 102 is mounted at the central portion of the sponge roller 101, a support 103 is connected to the end portion of the shaft 102 and to a hinge shaft 105 fixed to a mounting plate 104 so as to be rotated, a cylindrical rotating body 106 having an inside diameter to the extent that the shaft 102 can rotate centering around the hinge shaft 105 and being rotated by a motor 107 is fixed to a rotary plate 108 situated between the mounting plate 104 and the sponge roller 101.

The inlet portion of the power exhaust conveyor for packing, constructed as above, functions to feed the packing sheet containing medicine to the power exhaust conveyor.

The packing sheet fed to the power exhaust conveyor continues travelling but stops temporarily immediately before being fed to the heating rollers. At this moment, the sponge roller 101 moves centering around the hinge shaft 105 due to continuous traveling of the packing sheet on the power exhaust conveyor.

Once the heating rollers are actuated, the packing sheet is returned to the direction of the drawing's surface due to difference between travelling speed of packing sheet on the power exhaust conveyor and travelling speed of packing sheet by the heating rollers in order to allow the packing sheet to be discharged to the outside.

However, there is a disadvantage in that since the sponge roller does not rotate for itself and therefore it is difficult for the packing sheet containing medicine to be fed to the exhaust conveyor, the packing sheet near the heating rollers, feed roller and cutter may be folded and have an adverse effect on the operation of the heating roller and feed roller, and the packing sheet containing medicine may be deviated from the path, or may not be supported properly after being fed to the exhaust conveyor, therefore interfering with the operation of the exhaust conveyor.

Of course, the sponge roller may be rotated by the rotational force of the rotary plate if the sponge roller and the rotary plate comes into contact with each other but the rotational force of the rotary plate is not enough to rotate the sponge roller.

SUMMARY OF THE INVENTION

The present invention is contrived to overcome the conventional disadvantage described above. Therefore, it is an object of the present invention to provide an inlet rolling device of power exhaust conveyor for packing sheet used in sharing and packing device of medicine, which allows packing sheet to come into a power exhaust conveyor easily and the power exhaust conveyor to discharge the packing sheet to the outside easily by rotating an inlet sponge roller by means of power.

To achieve the above-described object, an inlet rolling device of power exhaust conveyor for packing sheet used in sharing and packing device of medicine, wherein the power exhaust conveyor is so constructed that a sponge roller is mounted on the inlet side, a shaft is mounted at the central portion of the sponge roller, and a support is connected to the end portion of the shaft and to a hinge shaft fixed to a mounting plate so as to be rotated, thereby enabling the packing sheet containing medicine to be discharged to the outside, comprises a hollow shaft attached to the central portion of the sponge roller and mounted to a shaft so as to be rotated, a primary pulley mounted on the end portion of the hollow shaft, a secondary pulley mounted on a hinge shaft so as to be rotated, a primary belt interconnecting the primary and secondary pulleys, and a secondary belt interconnecting the secondary pulley and a driving pulley mounted on the shaft of a motor for driving the exhaust conveyor.

DETAILED DESCRIPTION OF THE PREFERRED EMBODIMENTS

With reference to the accompanying drawings, the present invention will now be described.

Figure 1:
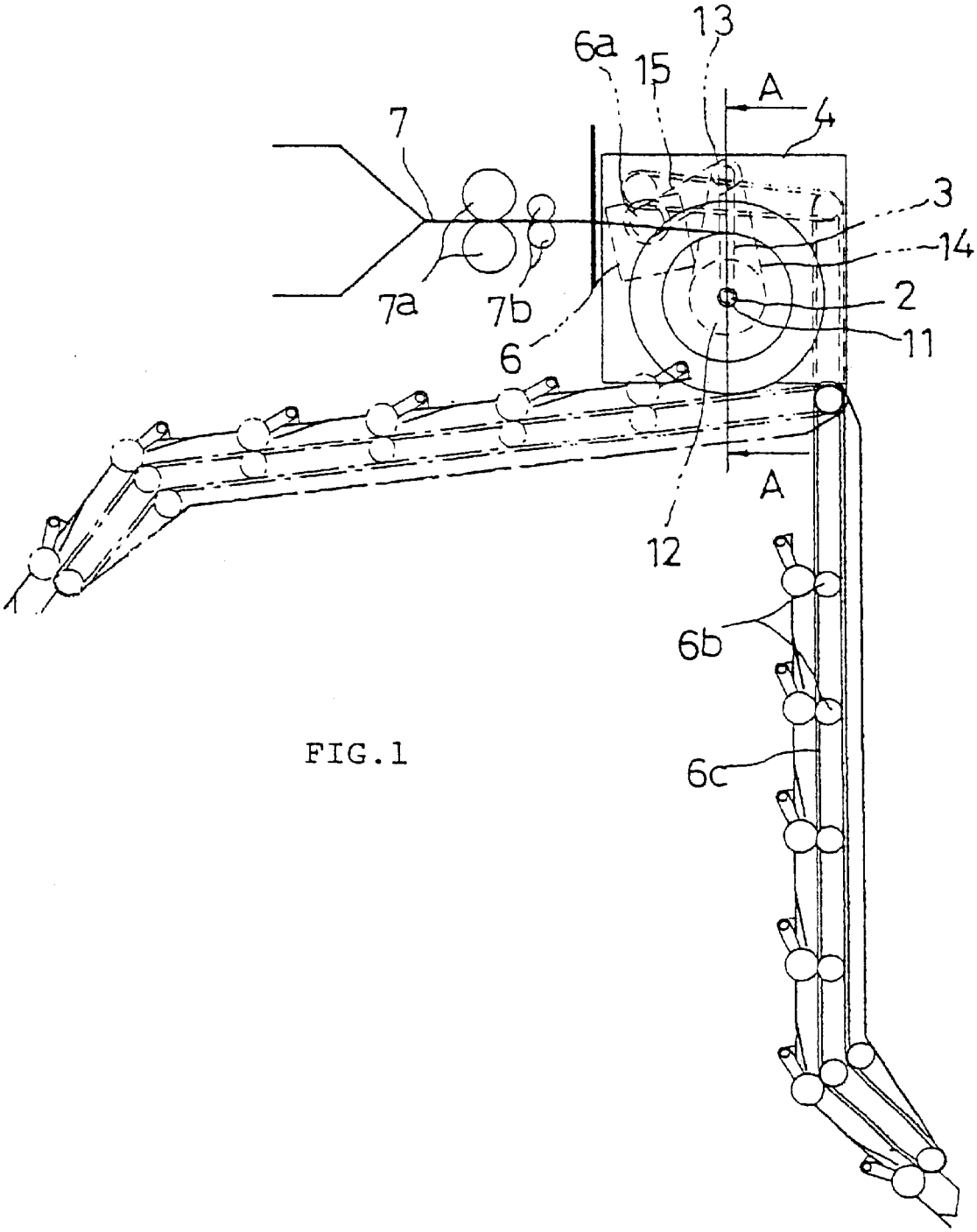
FIG. 1 is a rough view showing a power exhaust conveyor for packing used in sharing and packing device of medicine to which an inlet rolling device according to the present invention applies.

FIG. 1 shows a power exhaust conveyor for packing sheet used in sharing and packing device of medicine. The power exhaust conveyor is so constructed that a sponge roller 1 is mounted on the inlet side, a shaft 2 is mounted at the central portion of the sponge roller 1, and a support 3 is connected to the end portion of the shaft 2 and to a hinge shaft 5 fixed to a mounting plate 4 so as to be rotated, thereby enabling the packing sheet 7 containing medicine to be discharged to the outside by the power of a motor 6.

Figure 2:
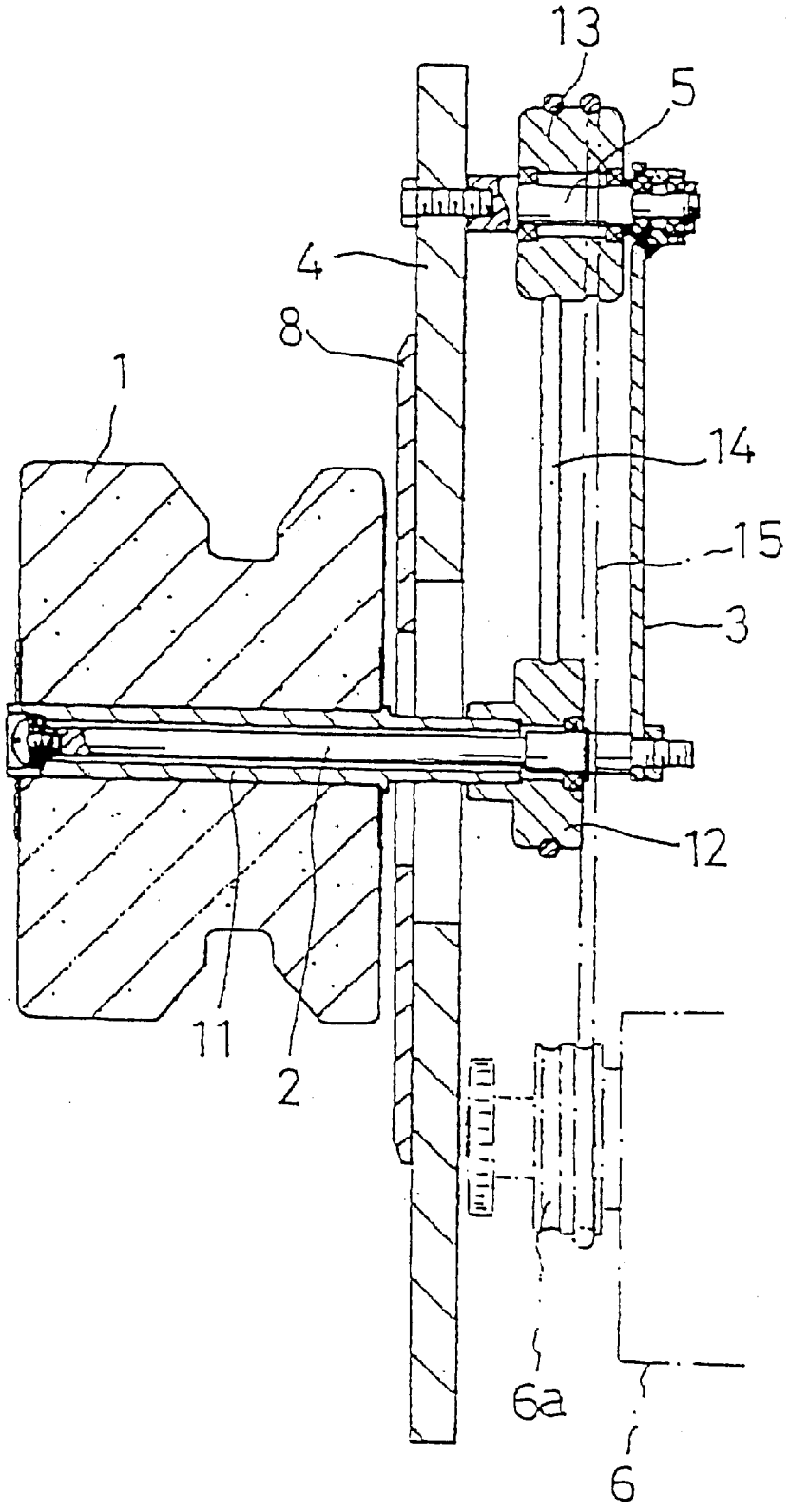
FIG. 2 is a cross-sectional view taken along line A—A of FIG. 1.
Figure 3:
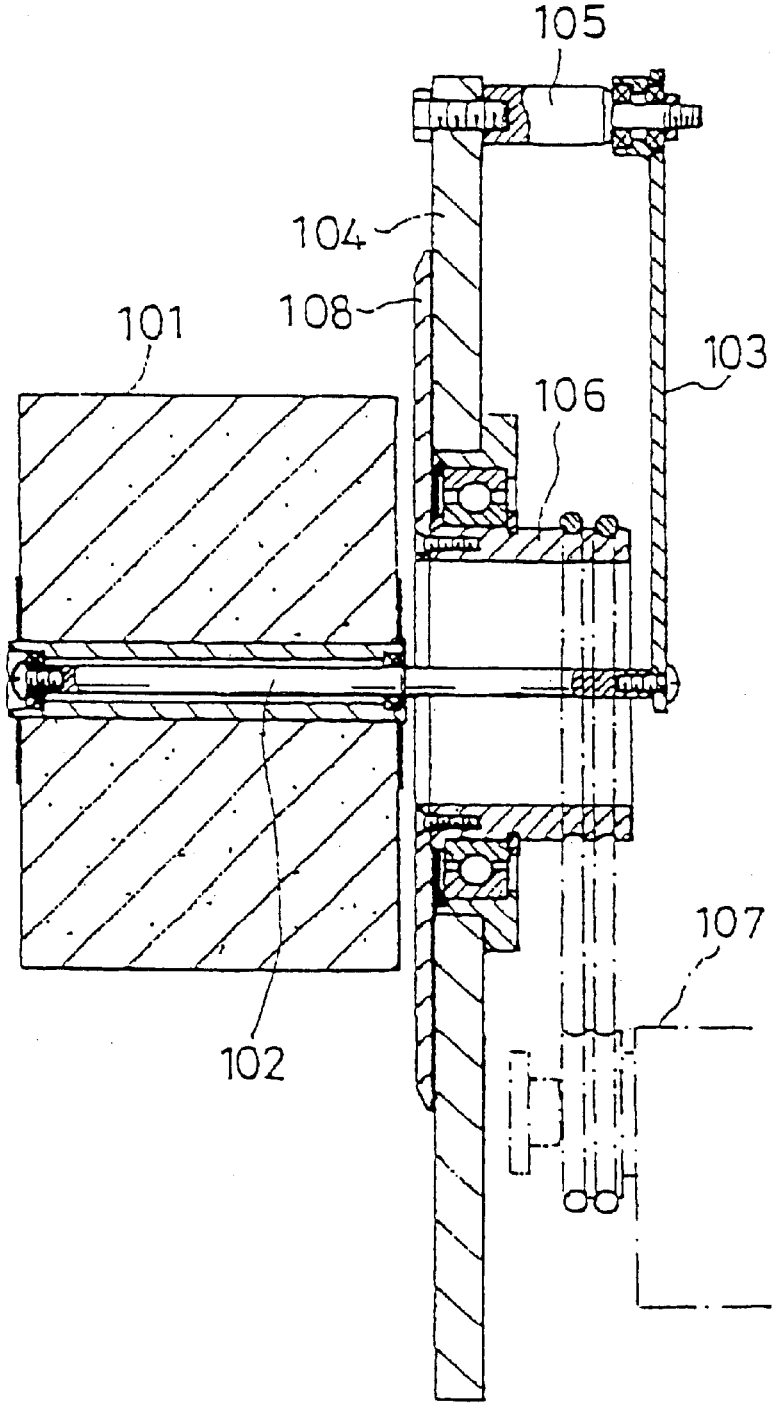
FIG. 3 (PRIOR ART)
FIG. 3 is a cross-sectional view showing a conventional inlet rolling device of power exhaust conveyor for packing sheet use in sharing and packing device of medicine.

An inlet rolling device of power exhaust conveyor for packing sheet used in sharing and packing device of medicine according to the present invention, as shown in FIGS. 1 and 2, comprises a hollow shaft 11 mounted to the shaft 2 so as to be rotated, a primary pulley 12 mounted on the end portion of the hollow shaft 11, a secondary pulley 13 mounted on the hinge shaft 5 so as to be rotated, a primary belt 14 interconnecting the primary and secondary pulleys 12 and 13, and a secondary belt 15 interconnecting the secondary pulley 13 and a driving pulley 6*a* mounted on the shaft of a motor for driving the exhaust conveyor. The sponge roller 1 is made of sponge retaining an elasticity to the extent that the packed medicine is not damaged when being pressed, and the hollow shaft 11 is attached to the central portion of the sponge roller 11.

Of course the conventional means for driving a rotary plate 8 can be removed, and as in the conventional case, a plurality of rollers 6*b* and belts 6*c* are driven by the power of the motor 6 to discharge the packing sheet 7 which travels by means of a pair of heating rollers 7*a* and feeding rollers 7*b*.

An inlet rolling device of power exhaust conveyor for packing sheet used in sharing and packing device of medicine according to the present invention works as follows.

Immediately before the packing sheet 7 is folded and fed into the heating rollers 7*a*, medicine (not illustrated) is dropped down into the inside of the packing sheet 7, and immediately after medicine is dropped down into the inside of the packing sheet 7, the heating rollers 7 and feed rollers 7*b* rotate to have the packing sheet 7 travel.

The end portion of the packing sheet 7 is fed smoothly into the power exhaust conveyor driven by the power of the motor 6 which is transmitted by way of the driving pulley 6*a*, the secondary belt 15, the secondary pulley 13, the primary belt 14, the primary pulley 12 and the hollow shaft 11.

On the other hand, at the moment when medicine is dropped into the packing sheet 7, the heating rollers 7*a* and feed rollers 7*b* stops temporarily but the power exhaust conveyor continues have the packing sheet 7 travel and accordingly the sponge roller 5 moves centering around the hinge shaft 5 while rotating.

The sponge roller 1 made of sponge allows the end portion of the packing sheet 7 to be spread easily without doing damage to the end portion of the packing sheet 7 and the packed medicine.

Once the heating rollers 7*a* are actuated again, the packing sheet 7 is returned to the direction perpendicular to the drawing's surface due to difference between travelling speed of packing sheet 7 on the power exhaust conveyor and travelling speed of the packing sheet 7 by the heating rollers 7*a* and feed rollers 7*b* in order to allow the packing sheet 7 to be discharged to the outside.

Therefore, the inlet rolling device is capable of discharging the packing sheet containing medicine to the outside smoothly although the heating rollers and feed rollers repeat start and stop.

As discussed above, the inlet rolling device of power exhaust conveyor for packing sheet used in sharing and packing device of medicine according to the present invention allows packing sheet to come into a power exhaust conveyor easily and the power exhaust conveyor to discharge the packing sheet to the outside easily by rotating an inlet sponge roller by means of power. As the inlet rolling device can be used easily even for the conventional packing and sharing devices of medicine, it will improve the efficiency of the conventional packing and sharing devices.

What is claimed is:

1. An inlet rolling device of power exhaust conveyor for packing sheet used in sharing and packing device of medicine, wherein the power exhaust conveyor is so constructed that a sponge roller is mounted on the inlet side, a shaft is mounted at the central portion of the sponge roller, and a support is connected to the end portion of the shaft and to a hinge shaft fixed to a mounting plate so as to be rotated, thereby enabling the packing sheet containing medicine to be discharged to the outside, comprising a hollow shaft attached to the central portion of said sponge roller and mounted to said shaft so as to be rotated, a primary pulley mounted on the end portion of said hollow shaft, a secondary pulley mounted on a hinge shaftso as to be rotated, a primary belt interconnecting said primary and secondary pulleys, and a secondary belt interconnecting said secondary pulley and a driving pulley mounted on a shaft of a motor for driving the exhaust conveyor.

* * * * *